United States Patent [19]

Bowers

[11] Patent Number: 4,635,576

[45] Date of Patent: Jan. 13, 1987

[54] STITCHED WOODWOOL MAT

[75] Inventor: Geoffrey Bowers, Sydney, Australia

[73] Assignee: Seasonmakers (Australia) Pty. Limited, Beaconsfield, Australia

[21] Appl. No.: 662,912

[22] Filed: Oct. 19, 1984

[30] Foreign Application Priority Data

Aug. 2, 1984 [AU] Australia ..... PG6352

[51] Int. Cl.[4] ..... B32B 7/08

[52] U.S. Cl. ..... 112/403; 112/262.3; 112/440; 405/16; 405/19; 428/233; 428/234; 428/236

[58] Field of Search ..... 428/233, 255, 234, 236; 405/16, 19; 112/403, 262.3, 440

[56] References Cited

U.S. PATENT DOCUMENTS

| | | | |
|---|---|---|---|
| 488,869 | 12/1892 | Cabat | 428/236 |
| 2,271,575 | 2/1942 | Waterman | 428/236 |
| 3,616,124 | 10/1971 | Danhel | 428/234 |
| 3,928,696 | 12/1975 | Wandel et al. | 405/19 |
| 4,353,946 | 10/1982 | Bowers | 405/19 |
| 4,472,086 | 9/1984 | Leach | 428/253 |

FOREIGN PATENT DOCUMENTS

| | | |
|---|---|---|
| 2408518 | 9/1975 | Fed. Rep. of Germany . |
| 81511 | 5/1982 | Japan . |
| 937565 | 6/1982 | U.S.S.R. . |

*Primary Examiner*—James C. Cannon

*Attorney, Agent, or Firm*—Millen & White

[57] ABSTRACT

A soil erosion control blanket formed from a mat of interlocking woodwool fibres, the mat of woodwool being retained as a coherent structure by means of longitudinal rows of stitching giving the blanket a quilted appearance.

16 Claims, 3 Drawing Figures

(a)

(b)

STITCHED WOODWOOL MAT

The present invention relates to erosion control and in particular to means to be applied to a ground surface for preventing or reducing its erosion and to a method of manufacturing such means.

Methods of controlling erosion on steeply sloping ground have previously entailed such action as forming gutters running transverse to the slope, application of interlocking concrete, and other slab arrangements. Other methods of erosion control include the use of jute sacking pegged to the soil and sprayed with bitumen and the use of bark and heavy wood chips covered with chicken wire. Such prior art methods are effective in arresting soil erosion but prevent and inhibit the growth of plants, grass and flora.

An improved method of controlling erosion has been successfully employed by the present applicants, wherein a mat of woodwool fibres retained in a coherent structure by means of a bio-degradable mesh, with which at least some of the fibres interlock, is laid on the surface to be protected and pinned to the surface as required by stakes, pegs or staples, such that the soil surface is stabilized until such time as vegetation can be re-established. Having re-established vegetation, the woodwool matting eventually breaks down to form a source of mulch for the new growth.

The present invention provides an improvement to the prior art woodwool mat and consists in a soil erosion control blanket comprising a mat of woodwool fibres, wherein some of the fibres interlock with one another, the mat being retained in a coherent structure by means of a plurality of unconnected longitudinal rows of stitching extending through the mat.

In the mat of the invention no further means of retaining the mat in a coherent structure is required.

Woodwool mat which is reinforced only by longitudinal rows of stitching, is suitable for use in the stabilization of sand dunes where due to the flatness and lower degrees of slopes no further means is necessary to help hold the woodwool fibres in position or to help retain the embankment or sand dune in any way and therefore the cost of stabilizing sand dunes can be reduced by using woodwool mat which does not have a mesh of plastics material applied.

The present invention consists in a method of forming a soil erosion control blanket comprising the steps of continuously producing a mat of intertangled woodwool fibres, said mat having a substantially constant cross-sectional area, and passing said mat through stitching means to insert a plurality of unconnected longitudinal rows of stitches extending through said mat.

Figure 1:
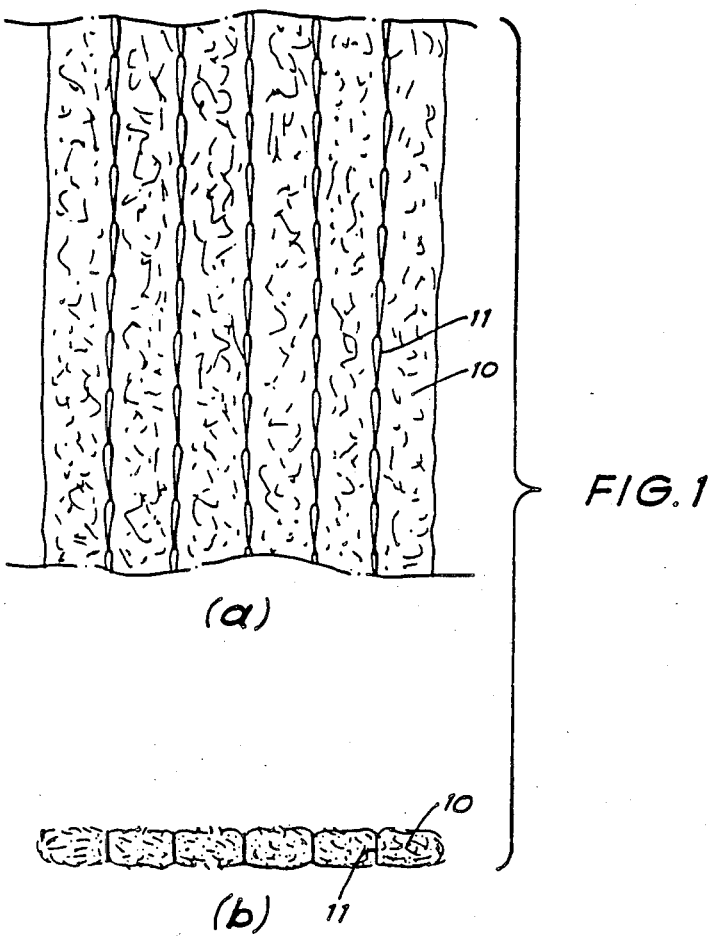
Figure 2:
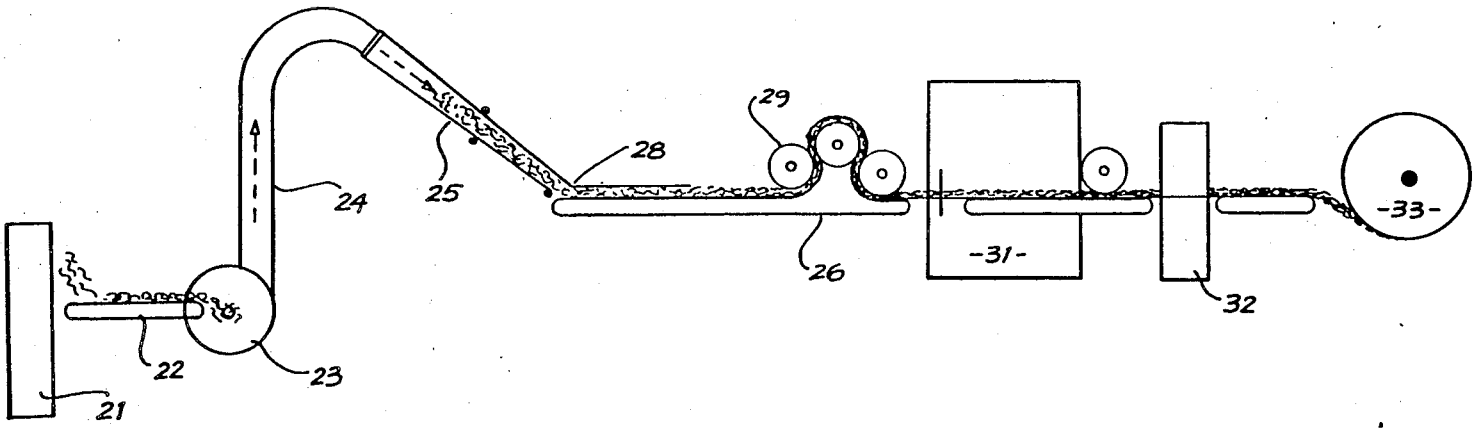

Embodiments of the invention will now be described by way of example with reference to the accompanying drawings in which:

FIG. 1 illustrates a length of woodwool mat according to the preferred embodiment of the present invention; and FIG. 2 schematically illustrates an apparatus for manufacturing embodiments of the invention.

Referring to FIG. 1(*a*) a segment of a continuous length of woodwool mat made in accordance with the preferred embodiment of the present invention is illustrated in plane view, while a sectional elevation of the mat of FIG. 1(*a*) is illustrated in FIG. 1(*b*). The woodwool fibre mat comprises a mass of woodwool fibres 10, each preferably in the order of 450 mm long when fully extended, the woodwool fibres being produced in such a manner that in the free state they form coils like clock springs, and each of the woodwool fibres in the mat being interlinked with a substantial number of others of the woodwool fibres in order to provide a reasonably coherent structure. Typically the woodwool fibre mat is in the order of 1.2 meters wide and has a thickness ranging between 10 and 65 mm depending upon the application to which it is to be put. The preferred embodiment of the invention is reinforced longitudinally by inserting rows of chain stitches 11 through the mat, these stitches providing a degree of resistance to longitudinal extension of the mat in use and also binding the fibres of the mat together to reduce tangling of fibres from adjacent layers of matting when the mat is rolled for storage and transportation. Typically, the spacing between rows of stitches 11 is in the order of 50 mm, however, this distance may be varied to suit the individual requirements of the project for which the matting is produced.

Turning now to FIG. 2, the apparatus required to manufacture the woodwool matting of FIG. 1 is schematically illustrated, wherein a shredding machine 21 comprising cutters (not shown) made in accordance with our earlier Australian Pat. No. 248,949, supplies shredded woodwool to a conveyor 22 which then feeds the woodwool into a fan 23. The woodwool is then blown via a duct 24 into a regulated storage hopper 25 which is tapered towards its lower end and works in conjunction with the kneading rollers 29 to regulate the thickness of the mat produced.

In the kneading rollers 29 the woodwool fibres are compressed to promote further interlinking of fibres. After leaving the kneading rollers 29 the woodwool mat passes through a stitching machine 31 which inserts longitudinal rows of continuous stitching through the matting, the needles of the stitching machine typically being placed to provide 50 mm intervals between stitching rows, but other intervals being achievable by removing selected needles from the machine. After passing through the stitching machine 31 the woodwool matting passes through a guillotine 32 and is then rolled onto a roll 33. When the desired length of matting has been rolled onto roll 33, the matting is chopped by guillotine 32 and the completed roll removed to storage ready for a new roll to be formed.

It will be recognised by persons skilled in the art that numerous variations and modifications may be made to the invention as described above without departing from the spirit or scope of the invention as broadly described.

I claim:

1. A soil erosion control blanket comprising a single layer mat of woodwool fibers, wherein some of the fibers interlock with one another, the mat being retained in a coherent structure only by means of a plurality of laterally unconnected longitudinal rows of stitching extending through the mat and interlocking between the fibers.

2. The soil erosion control blanket of claim 1 wherein each woodwool fibre is configured as a coil.

3. The soil erosion control blanket of claim 2 wherein each woodwool fiber is approximately 450 mm long when the fiber is stretched out.

4. The soil erosion control blanket of claim 3 wherein the mat is in the range of about 10 mm to about 65 mm thick.

5. The soil erosion control blanket of claim 4 wherein the spacing between the rows of stitches is approximately 50 mm.

6. The soil erosion control blanket of claim 5 wherein the mat is a single layer with the stitching exposed on both sides of the mat.

7. The soil erosion control blanket of claim 6 wherein the stitching is formed by chain stitches.

8. The soil erosion control blanket of claim 1 wherein the mat is a single layer with the stitching exposed on both sides of the mat.

9. The soil erosion control blanket of claim 8 wherein the stitching is formed by chain stitches.

10. A method of forming a soil erosion control blanket comprising the steps of continuously producing a mat of intertangled woodwool fibers, said mat having a substantially constant cross-sectional area, and passing a single layer of said mat through stitching means to insert a plurality of laterally unconnected longitudinal rows of stitches extending through said mat and interlocking between tthe fibers thereof, said mat thereby being retained in a coherent structure only by means of said unconnected longitudinal rows of stitches.

11. A method as claimed in claim 4 wherein the woodwool fibers are kneaded to interlock some of the fibers prior to insertion of the rows of stitches.

12. The method of claim 11 wherein the woodwool fibres are approximately 450 mm long and are coiled and wherein the mat is compressed and stitched to maintain a thickness in the range of about 10 mm to about 65 mm.

13. The method of claim 12 further including the step of placing the stitches in rows 50 mm apart.

14. The method of claim 13 further including the step of rolling the mats into rolls for storage and transport subsequent to forming the mat.

15. The method of claim 14 wherein the continuously produced mat is periodically cut after a roll having a desired unrolled length of mat is produced.

16. The method of claim 11 wherein the fibers are uniformly distributed to form the mat by the step of entraining the fibres in a stream of air prior to depositing the fibres in a mass and prior to kneading the fibres to interlock at least some of the fibres.

* * * * *